US011622909B2

(12) United States Patent
Wersland et al.

(10) Patent No.: US 11,622,909 B2
(45) Date of Patent: Apr. 11, 2023

(54) MASSAGE ROLLER ASSEMBLY

(71) Applicant: Therabody, Inc., Los Angeles, CA (US)

(72) Inventors: Jason Wersland, Manhattan Beach, CA (US); Benjamin Nazarian, Beverly Hills, CA (US); Jaime Sanchez Solana, Los Angeles, CA (US); Eduardo Merino, Beverly Hills, CA (US)

(73) Assignee: Therabody, Inc., Los Angeles, CA (US)

( * ) Notice: Subject to any disclaimer, the term of this patent is extended or adjusted under 35 U.S.C. 154(b) by 388 days.

(21) Appl. No.: 17/087,851

(22) Filed: Nov. 3, 2020

(65) Prior Publication Data

US 2021/0128399 A1 May 6, 2021

Related U.S. Application Data

(60) Provisional application No. 62/983,964, filed on Mar. 2, 2020, provisional application No. 62/930,415, filed on Nov. 4, 2019.

(51) Int. Cl.

| | |
|---|---|
| ***A61H 15/00*** | (2006.01) |
| ***A61H 23/00*** | (2006.01) |
| ***A61H 23/02*** | (2006.01) |

(52) U.S. Cl.

CPC ..... *A61H 15/0092* (2013.01); *A61H 23/006* (2013.01); *A61H 2023/029* (2013.01); *A61H 2201/1695* (2013.01); *A61H 2201/50* (2013.01)

(58) Field of Classification Search

CPC ..... A61H 1/00; A61H 15/00; A61H 15/0092; A61H 23/006; A61H 23/02;

(Continued)

(56) References Cited

U.S. PATENT DOCUMENTS

| | | | |
|---|---|---|---|
| 5,554,102 | A | 9/1996 | Chiou |
| 5,637,065 | A | 6/1997 | Chang |

(Continued)

FOREIGN PATENT DOCUMENTS

| | | |
|---|---|---|
| CN | 210277532 | 4/2020 |
| DE | 202016104211 | 9/2016 |

(Continued)

OTHER PUBLICATIONS

The VIPER by Hyperice: Move Better. Feel Better., Jul. 20, 2014 (https://www.kickstarter.com/projects/74007868/the-vyper-by-hyperice).

(Continued)

*Primary Examiner* — Justine R Yu
*Assistant Examiner* — Matthew D Ziegler
(74) *Attorney, Agent, or Firm* — Sterne, Kessler, Goldstein & Fox P.L.L.C.

(57) ABSTRACT

A massage roller assembly that includes a cylindrical main body portion that defines a roller axis and includes an outer roller surface and that includes a plurality of massage members. A plurality of radially extending tunnels are defined in the cylindrical main body portion and through the outer roller surface. The massage members are associated with the cylindrical main body portion and are each configured to reciprocate in a radial direction between a stowed position and a deployed position. In the deployed position at least a portion of the first and second massage members are positioned radially outwardly of the cylindrical main body portion.

10 Claims, 8 Drawing Sheets

(58) Field of Classification Search
CPC ..... A61H 2015/0014–0021; A61H 2023/02; A61H 2023/0254; A61H 2023/0263; A61H 2023/029; A61H 2201/1207; A61H 2201/1215; A61H 2201/1418; A61H 2201/1669; A61H 2201/1671; A61H 2201/1695; A61H 2201/50; A61H 39/04
See application file for complete search history.

(56) References Cited

U.S. PATENT DOCUMENTS

| | | | | |
|---|---|---|---|---|
| 6,647,572 | B2 | 11/2003 | Lee | |
| 6,929,612 | B2 | 8/2005 | Mangano | |
| 7,341,566 | B2 | 3/2008 | Nan | |
| 7,510,537 | B2 | 3/2009 | Imboden | |
| 7,828,717 | B2 * | 11/2010 | Lee | A61H 19/34 600/38 |
| 8,500,663 | B2 | 8/2013 | Godfrey | |
| 9,066,843 | B1 * | 6/2015 | Greco | A61H 19/44 |
| 9,132,055 | B1 | 9/2015 | Wallace | |
| 9,174,079 | B2 | 11/2015 | Berger | |
| 9,192,542 | B2 | 11/2015 | Blenk | |
| 9,968,513 | B1 | 5/2018 | Marton | |
| 10,085,913 | B2 | 10/2018 | Blenk | |
| D837,636 | S | 1/2019 | Wersland | |
| 10,182,962 | B2 | 1/2019 | Godfrey | |
| D845,499 | S | 4/2019 | Wersland | |
| D845,500 | S | 4/2019 | Wersland | |
| D849,260 | S | 5/2019 | Wersland | |
| D849,261 | S | 5/2019 | Wersland | |
| 10,285,901 | B2 | 5/2019 | Godfrey | |
| D850,639 | S | 6/2019 | Wersland | |
| D850,640 | S | 6/2019 | Wersland | |
| 10,449,112 | B2 | 10/2019 | Godfrey | |
| 10,617,588 | B2 | 4/2020 | Wersland | |
| 10,729,614 | B2 | 8/2020 | Marton | |
| 2009/0069730 | A1 * | 3/2009 | Knyrim | A61H 23/0263 601/134 |
| 2012/0065557 | A1 | 3/2012 | Phillips | |
| 2013/0012848 | A1 | 1/2013 | Forrest | |
| 2013/0281892 | A1 | 10/2013 | Godfrey | |
| 2015/0148718 | A1 | 5/2015 | Eigler | |
| 2015/0190304 | A1 | 7/2015 | Lawrie | |
| 2016/0113841 | A1 | 4/2016 | Godfrey | |
| 2016/0158096 | A1 | 6/2016 | Godrey | |
| 2016/0302994 | A1 * | 10/2016 | Chen | A61H 23/0254 |
| 2017/0216136 | A1 | 8/2017 | Gordon | |
| 2018/0200141 | A1 | 7/2018 | Wersland | |
| 2019/0017528 | A1 | 1/2019 | Wersland | |
| 2020/0261307 | A1 | 8/2020 | Wersland | |

FOREIGN PATENT DOCUMENTS

| | | | |
|---|---|---|---|
| DE | 202018102706 | | 9/2019 |
| JP | 09140758 | H | 6/1997 |
| KR | 20130032935 | A | 4/2013 |
| WO | 2016153551 | A1 | 9/2016 |
| WO | 2017050525 | A1 | 3/2017 |

OTHER PUBLICATIONS

Vibrating Massage Rod, 2010 (https://www.semanticscholar.org/paper/Vibrating-massage-rod-%E6%9B%BE%E9%9B%AA%E9%B9%8F/1a16b9612a75bc1697e669c6a60d1c0efe82e545).

Einarmmontage, Madeleine Westerholm (https://www.semanticscholar.org/paper/Roller-body-unit-for-a-vibrating-roller-to-Lacken-Rommer/9bd791ac3484c2c9c3cc607cfd146b879b5ee0e1).

Effect of Vibration Foam Rolling and Non Vibration Foam Rolling in the Lower Extremities on Jump Height, Undray Bailey, 2014 (https://dc.ewu.edu/cgi/viewcontent.cgi?article=1258&context=theses).

Youtube, PowerRoll—met diepe massagewerking, Medisana Benelux, Feb. 6, 2015 (https://www.youtube.com/watch?v=XT3pHrSLWn8).

Youtube, Vibration Foam Rolling, PFP media, Dec. 15, 2014 (https://www.youtube.com/watch?v=FfjpbHng5V0).

Int;l Search Report and Written Opinion issued in PCT/US/20/58670.

* cited by examiner

MASSAGE ROLLER ASSEMBLY

CROSS REFERENCE TO RELATED APPLICATIONS

This application claims the benefit of U.S. Provisional Application No. 62/983,964, filed Mar. 2, 2020 and U.S. Provisional Patent Application No. 62/930,415, filed Nov. 4, 2019, the entireties of which are incorporated by reference herein.

FIELD OF THE INVENTION

The present invention relates generally to a massage roller, and more particularly to a massage roller with reciprocating members.

BACKGROUND OF THE INVENTION

Vibrating massage rollers that are typically made of foam are known. For example, see U.S. Patent Publication No. 2016/0113841, the entirety of which is incorporated by reference herein. Furthermore, percussive massage devices that include interchangeable massage attachments are known. For example, see U.S. Patent Publication No. 2018/0200141 and U.S. Pat. Nos. D849260, D850639, D845499, D845500, D850640, D849261, the entireties of which are incorporated by reference herein. The design patents listed above all disclose interchangeable massage attachments.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention there is provided a massage roller assembly that includes a cylindrical main body portion that defines a roller axis and includes an outer roller surface and that includes a plurality of massage members. A plurality of radially extending tunnels are defined in the cylindrical main body portion and through the outer roller surface. The massage members are associated with the cylindrical main body portion and are each configured to reciprocate in a radial direction between a stowed position and a deployed position. In the deployed position at least a portion of the first and second massage members is positioned radially outwardly of the cylindrical main body portion.

In a preferred embodiment, the massage roller assembly includes at least a first motor. The motor rotates a motor shaft and rotation of the motor shaft is converted to reciprocating motion to reciprocate the massage members between the stowed and deployed positions. Preferably, the massage roller assembly includes a plurality of push rod assemblies that each include a distal end and each of the massage members are located at the distal ends of the push rod assemblies. In a preferred embodiment, the motor shaft rotates a counterweight that is operatively connected to or operatively associated with at least one of the push rod assemblies.

In a preferred embodiment, the rotating shaft is a cam shaft that includes at least a first cam path that moves at least a first massage member of the plurality of massage members between the stowed and deployed positions. Preferably, the massage members are biased to the stowed position via a spring, biasing member or the like.

In a preferred embodiment, the massage roller assembly includes an outer cover that at least partially surrounds the cylindrical main body portion and the massage members deflect the outer cover when moving from the stowed position to the deployed position. In a preferred embodiment, the outer cover includes a plurality of massage protrusions that each define a protrusion interior and the massage members move radially outwardly into the protrusion interiors of the massage protrusions when moving to the deployed position (they can deflect the outer wall of the massage protrusion or just move into the protrusion interior space without touching and/or deflecting the outer wall.

In a preferred embodiment, the plurality of tunnels each include a massage member recess (the massage member recess may be the same diameter or have the same width dimension as the remainder of the tunnel). The outer surface defines an outer surface extended that extends over the massage members recesses. In the stowed position the massage members are positioned radially inwardly of the outer surface extended.

In a preferred embodiment, the massage roller assembly includes a controller that controls the reciprocation of the massage members. Preferably, the plurality of massage members comprises at least a first set and a second set and the controller is configured to reciprocate the first set separately from the second set. A set can be any number of different massage members, including a single massage member. For example, a set can be a row, a portion of a row, a ring or column or a portion of a ring or column, a quadrant, a half, a pair, etc. In a preferred embodiment, the controller is configured to move the first massage member to the stowed position and then remain in the stowed position, thereby providing a protrusion for a user to "roll" on to affect a desired body part.

Generally, the present invention includes a plurality of reciprocating massage members that are selectively reciprocated outwardly to provide an undulating surface that can provide therapy, massage or the like to a user of the roller. In a preferred embodiment, the massage members are reciprocated radially outwardly, as shown in the drawings. The massage members can each be located at the distal end of a push rod assembly that is driven by a motor. The drive train can be similar to that of a percussive massage or therapy device, as taught in U.S. patent application Ser. No. 16/824,328, filed Mar. 19, 2020 and U.S. Patent Publication No. 2020/0261307, the entireties of which are incorporated by reference herein. One or more motors reciprocate the massage members. The motors may provide rotational motion via a shaft that is converted to reciprocating motion, for example, via one or more cam shafts, one or more crank shafts, counterweights, gearing, etc. The rotational motion can be converted to reciprocal motion of a rod or push rod that includes one or more massage members of protruding members on the distal end thereof. In another embodiment the motors can directly provide the reciprocating motion.

Different sets of massage members can be reciprocated outwardly at different times. For example a row or line of massage members can all reciprocate outwardly together or a section that includes a portion of a row and a portion of a ring of massage members can all reciprocate outwardly together.

In a preferred embodiment, the massage roller assembly includes an outer cover. The outer cover can include massage protrusions into which the massage members reciprocate. In this embodiment, the massage members essentially enter the protrusion interior so that a user feels the massage member through the outer cover when using the device. The massage members can be completely radially inward of the outer roller surface extended (i.e., if the outer roller surface extended over the outer opening of the radially extending tunnels) in the stowed or starting position and then extend at least partially outside of the radially extending tunnels (or the massage member recess portions thereof). In another embodiment, the massage members can extend at least partially outside of the outer roller surface extended in the stowed or starting position and then extends at least partially further outside of the radially extending tunnel. In another embodiment, the massage protrusions can be omitted and the massage members can deflect or stretch the outer cover when they move to the deployed position.

In another preferred embodiment, the outer cover is omitted and the massage members can operate as described in the above paragraph. In either embodiment, the massage members can be removable or interchangeable and replaced with other or different massage members. In the embodiment that includes the outer cover, but where the massage members are removable, the outer cover can be removable. Or, the massage protrusions can be removable or openable to access the massage members and remove and replace them. In another embodiment, the massage members can be permanent.

The present invention is a massage roller assembly, undulating massage roller or vibrating massage roller. In a preferred embodiment, the massage roller assembly includes a cylindrical main body portion with a plurality of massage members or massage attachments protruding away from the external surface of the main body portion. In a preferred embodiment, the massage members are shaped similarly to at least some of the massage attachments shown in the design patents that are incorporated by reference above. The massage members can also take shapes. A single type or shaped massage member can be used throughout the entire cylinder or roller. In another embodiment more than one type or shaped massage member can be used. As a result, the outside or contact surface (the surface that contacts a user) is comprised of the distal ends of the massage members.

In a preferred embodiment, the vibrating roller assembly includes different portions, sections or quadrants of the exterior of the cylinder. A different type of massage member can be used in each quadrant. For example, the first quadrant can include a set of dampener massage members, the second quadrant can include a set of small ball massage members, the third quadrant can include a set of wedge massage members, and the fourth quadrant can include a set of cone massage members. The massage members can be permanently affixed to the main body portion (e.g., on posts or the like) or can include an attachment system that provides the ability to remove and replace massage members. For example, any of the attachment systems taught in U.S. Patent Publication No. 2019/0017528 and D837636, the entireties of which are incorporated herein by reference, can be used.

The massage members can all vibrate, reciprocate or move at the same amplitude and frequency or some can operate at a different amplitude and frequency than others. Furthermore, the massage members can move in synchrony or can move in alternating type patterns. For example, a set of axially spaced massage members can move up and down (or in and out, with respect to the main body portion) in a wave pattern. A row or a portion of a row can reciprocate at the same time or ring or a portion of a ring can reciprocate at the same time.

In a preferred embodiment, the vibrating roller assembly includes one or more internal motor or other device that provides vibration to the external surface thereof or reciprocates the massage members. In a preferred embodiment, the massage roller assembly includes buttons and a display screen (can be a touch screen) on an end thereof for stopping, starting, activating, etc. The screen can also include other functions. The device can include other controllers, such as a thumbwheel or rolling button positioned near the touch screen/on off button to allow the user to scroll or navigate through the different functions.

In a preferred embodiment, the massage roller assembly includes a touch screen, a center button, for turning the device on and off and a ring/rocker button that provides the ability to scroll left and right (e.g., to the preset treatments discussed herein) and up and down (e.g., to control the speed, amplitude or frequency). The screen can also be a non-touch screen.

In a preferred embodiment, the massage roller assembly includes a wireless charging assembly or capability that provides the ability to charge the battery without plugging the battery or the device into anything. Preferably, the massage roller assembly can be received in a charging device or stand, e.g., in a vertical orientation. The charging transmitted is located in the stand and the charging receiver is located in the end of the massage roller.

In another embodiment, the vibrating roller assembly includes a cylindrical main body portion, core or shell housing halves, a motor, a PCB panel, a counterweight, a wireless charger assembly (receiver), an end cap, an on/off button and speed buttons that allow the frequency or speed of the vibrations (based on the speed of the motor/counterweight) to be raised or lowered (e.g., five different speeds). The core housing halves define a housing interior where the motor and counterweight are housed. The motor rotates the counterweight, which causes the housing and cylindrical main body portion to vibrate.

In another preferred embodiment, the massage roller assembly includes massage members are contained within an outer membrane or cover. The massage members reciprocate or move inwardly and outwardly (i.e., in a radial direction) and push against the membrane to provide a massage against the user.

In a preferred embodiment, any of the massage roller assemblies discussed herein can be associated with and can be operated by an app or software that runs on a mobile device such as a phone, watch or tablet (or any computer). The app can connect to the massage roller assembly via bluetooth or other connection protocol. For example, for the massage roller assembly can include bluetooth capability in the PCB panel. The app can have any or all of the following functions. Furthermore, any of the functions discussed herein can be added to the touch screen/scroll wheel or button(s) capability directly on the device. If the user walks or is located too far away from the device, the device will not work or activate. The device can be turned on an off using the app as well as the touch screen or button on the device. The app can control the variable speeds (speed or frequency of vibration in vibrating massage roller) or amplitude/stroke (e.g., of any of the massage members). A timer so the device stops after a predetermined period of time. The app can also include different treatment protocols associated therewith. This will allow the user to choose a protocol or area of the body they want to work on. When the start of the protocol is selected, the device will run through a routine. For example, the device may run at a first RPM for a first period of time and then run at a second RPM for a second period of time and/or at a first amplitude for a first period of time and then run at a second amplitude for a second period of time. The routines can also include prompts (e.g., haptic feedback) for letting the user to know to move to a new body part. These routines or treatments can be related to recovery, blood flow increase, performance, etc. and can each include a preprogrammed routine. The routines can also prompt or instruct the user to switch massage members or switch to a different quadrant or area of the device that includes different massage members than are currently being used. The prompts can include sounds, haptic feedback (e.g., vibration of the device or mobile device), textual instructions on the app or touch screen, etc. For example, the app may instruct the user to start by rolling on the device in quadrant one. Then the user hits start and the device runs at a first frequency for a predetermined amount of time. The app or device then prompts the user to begin the next step in the routine and instructs the user to change to rolling in quadrant two. The protocols can include control of or prompts for the user to control or change speed/frequency, amplitude, time, on/off, temperature (if the vibrating roller assembly, or outer surface thereof, is heated), force, massage member used.

In a preferred embodiment, the app includes near field communication ("NFC") capability or other capability that allows the user's mobile device with the app thereon to scan an identifier, such as a barcode or a QR code that prompts the app to display certain information, such as the routines discussed above. In use, a user will be able to tap or place their mobile device near an NFC tag (or scan a QR code) on a piece of gym equipment and the app will show instructions, content or a lesson that is customized for using the massage roller assembly with that piece of equipment. For example, on a treadmill, the user scans the QR code or NFC tag and the app recognizes that the user is about to use the treadmill. The app can then provide instructions for how to use the device in conjunction with the treadmill and can initiate a preprogrammed routine for using the treadmill. For example, the user can be instructed to start with the left quad. Then, after a predetermined period of time (e.g., 15 seconds), the massage roller assembly vibrates or provides other haptic feedback. The user then switches to their left quad and after a predetermined period of time the device again vibrates. The user can then begin using the treadmill. Any routine is within the scope of the present invention. In an embodiment, the device and/or app (i.e., the mobile device containing the app) can also communicate (via bluetooth or the like) with the gym equipment (e.g., treadmill).

The device can also include a torque or force meter to let the user know how much force they are applying and shows how much force is being applied on the muscle. In a preferred embodiment, the device includes a torque measuring sensor and display. Depending on the muscle the device is being used on and the benefit the user is looking to get (prepare, perform, recover) the force that should be applied varies. By having a force sensor, the user will be able to get a more precise and personalized treatment. The app and the touchscreen can provide the force information to the user. The force meter can be integrated with the routines and the user can be provided feedback with whether they are applying too much or too little pressure. The device can also include a thermal sensor or thermometer that can determine the temperature of the user's muscle and to provide feedback to the device and/or app. The haptic feedback can also provide feedback for too much pressure or force. The force meter can provide feedback to the user based on how much weight is being placed on the device (since a foam roller works based on a user placing their body weight on the device) and can notify the user (via sounds, haptic feedback, lights, etc.) whether to place more or less weight on the device or portion of the device.

The battery may be any type of battery known in the art. For example, the battery may include a rechargeable lithium-ion (LiIon) based battery. In another example, the battery may include a rechargeable nickel metal hydride (NiMH) battery. In yet another example, the battery may include a rechargeable lithium-polymer (LiPo) battery. In some embodiments, the battery includes a nickel-cadmium (NiCad) battery. In one embodiment, the battery uses a non-rechargeable battery.

BRIEF DESCRIPTION OF THE DRAWINGS

Like numerals refer to like parts throughout the several views of the drawings.

DETAILED DESCRIPTION OF THE PREFERRED EMBODIMENTS

Figure 1:
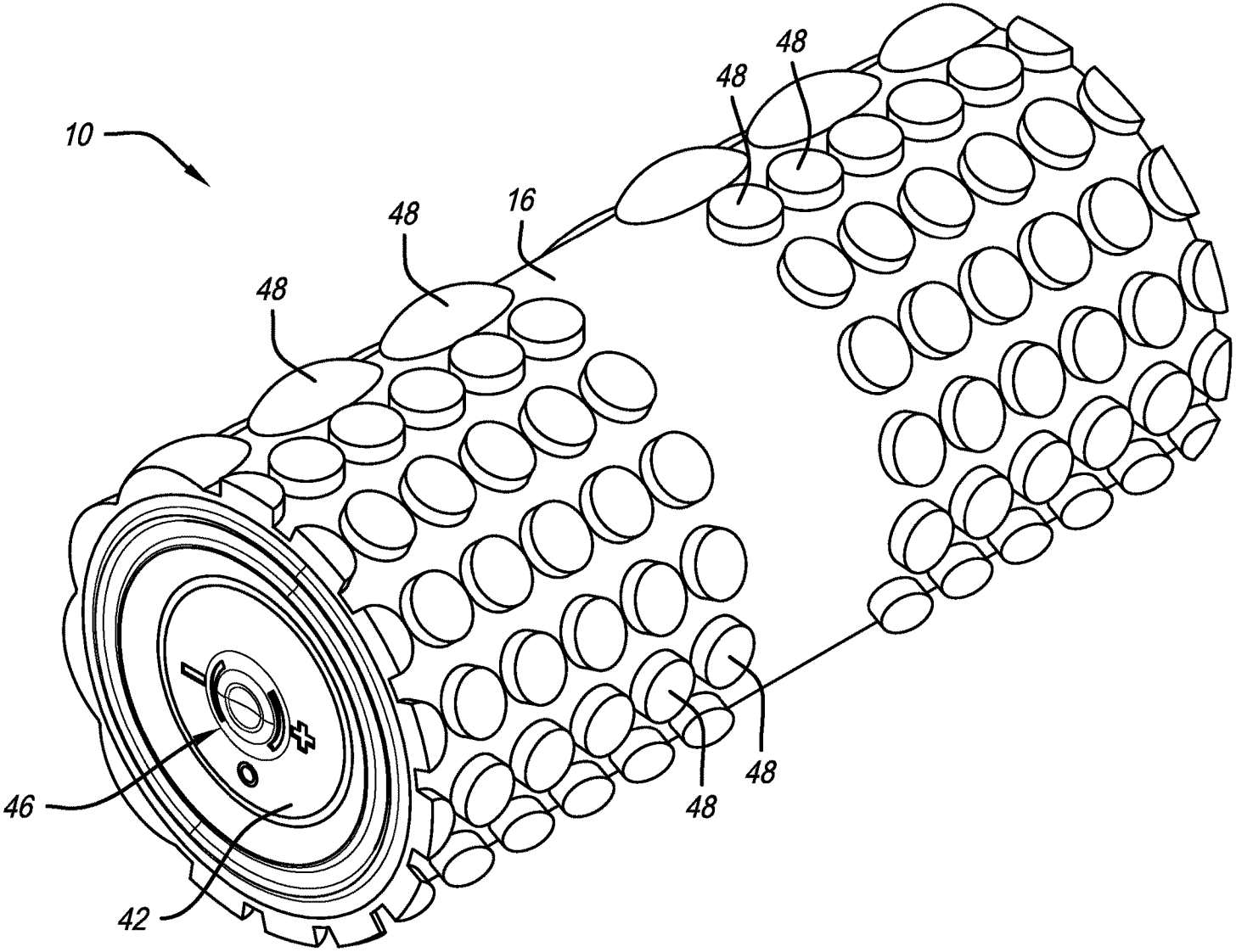
FIG. 1 is a perspective view of a massage roller assembly in accordance with a preferred embodiment of the present invention attached thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way.

Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 2:
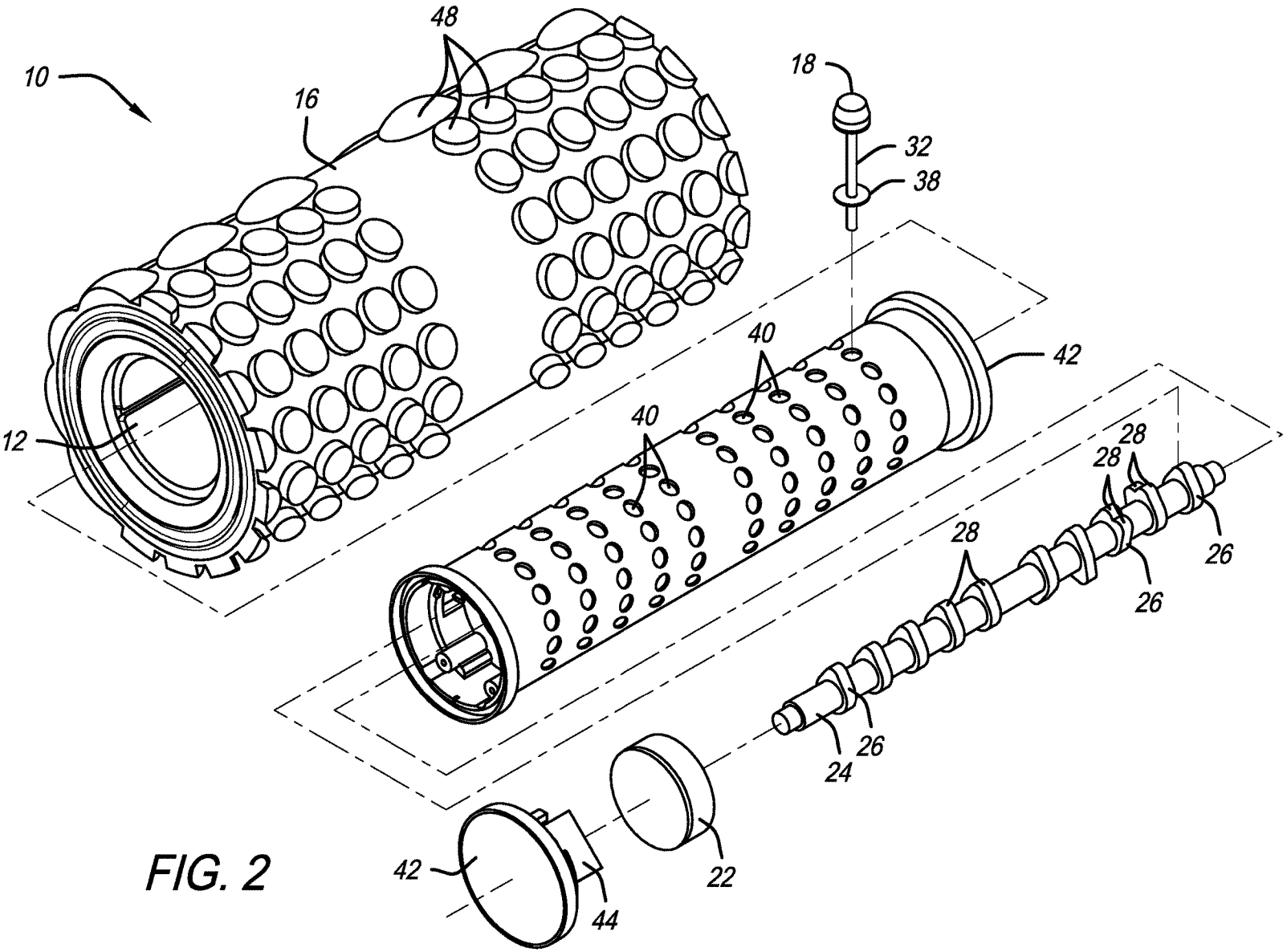
FIG. 2 is an exploded perspective view of the massage roller assembly.
Figure 3:
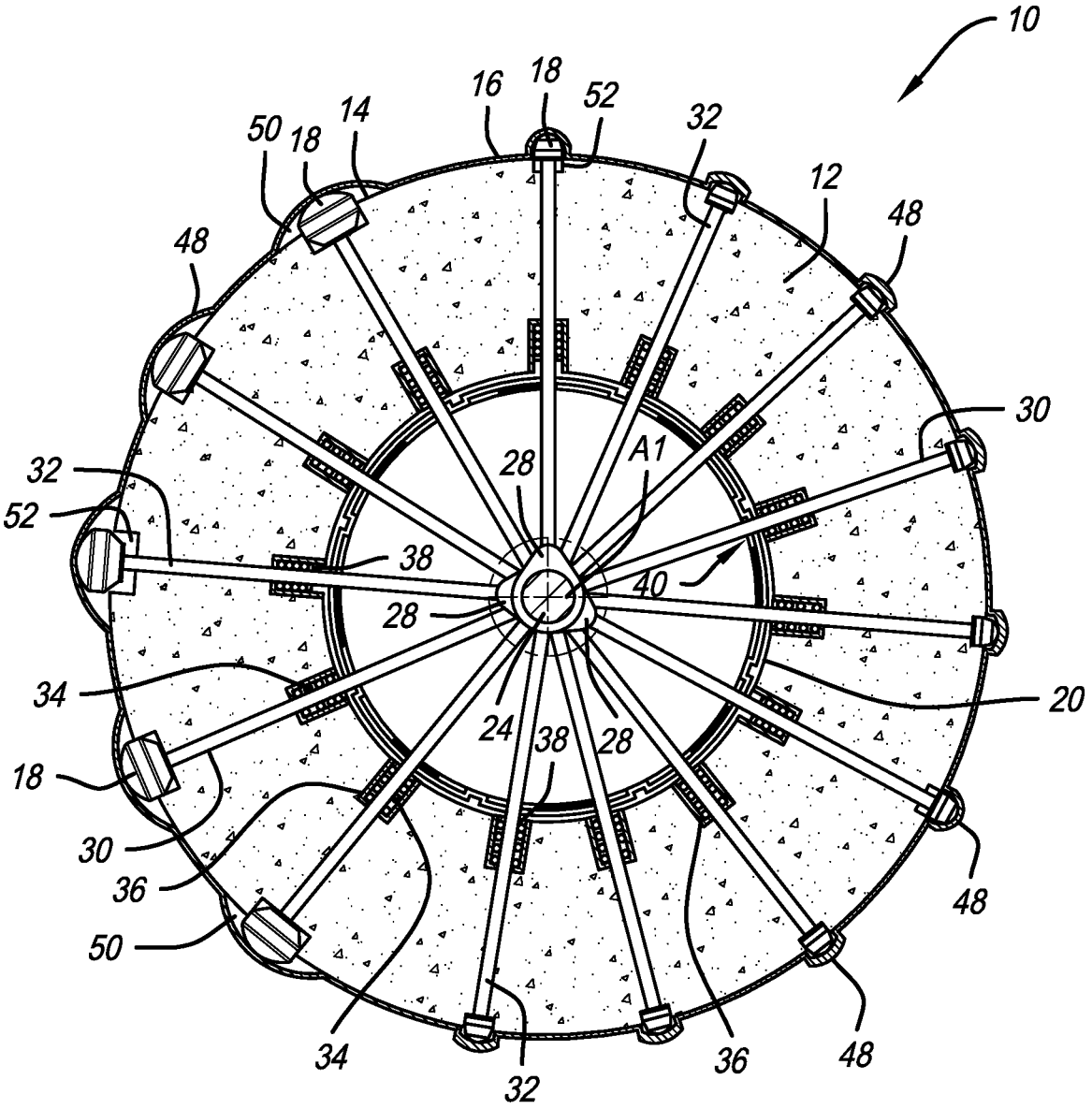
FIG. 3 is a cross-sectional end view of the massage roller assembly.

Referring now to the drawings, which are for purposes of illustrating the present invention and not for purposes of limiting the same, the drawings show a massage roller assembly 10 that includes an undulating outer surface. As shown in FIGS. 1-3, the massage roller assembly 10 generally includes a cylindrical main body portion 12 that defines a roller axis A1 and includes an outer roller surface 14, an outer cover 16 and a plurality of reciprocating massage members 18. The outer roller surface 14 of the cylindrical main body portion 12 is not necessarily the surface used for contact with a user. As shown in FIG. 3, the outer roller surface 14 is inside the outer cover 16. However, in the embodiment shown in FIG. 4, the outer cover is omitted.

In a preferred embodiment, the massage roller assembly 10 includes an inner shell 20 that may include separate halves or portions. The inner shell 20 preferably houses the motor(s) 22 and one or more batteries. In a preferred embodiment, the motor 22 rotates a motor shaft and the rotational motion is converted to reciprocating motion to reciprocate one or more of the massage members 18 between the stowed and deployed positions. As shown in FIG. 2, in a preferred embodiment, the massage roller assembly 10 includes a cam shaft 24 that is co-axial with the roller axis A1. The cam shaft 24 includes a plurality of cam paths 26 that include one or more lobes 28 thereon.

Figure 4:
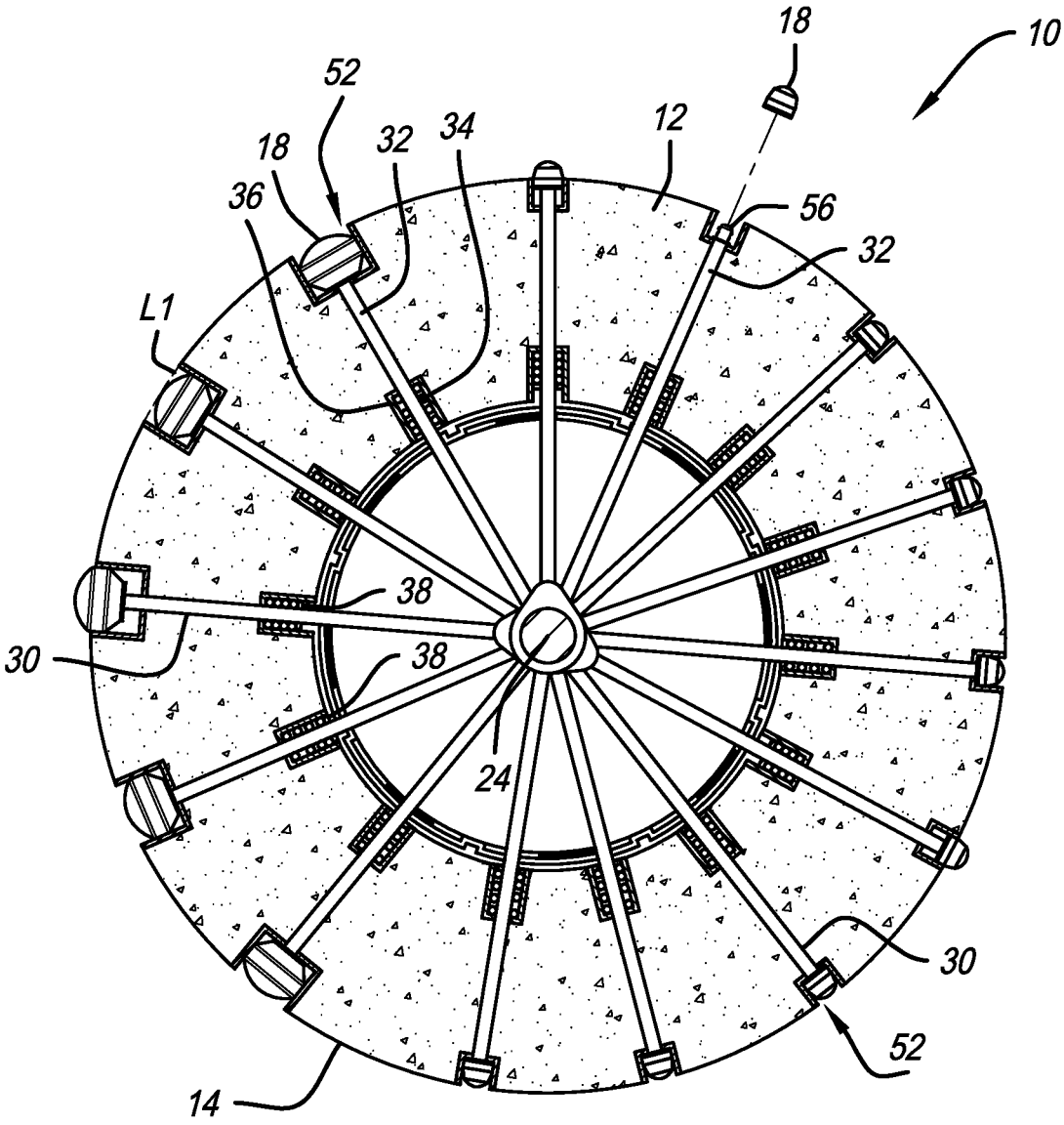
FIG. 4 is a cross-sectional end view of a massage roller assembly in accordance with another embodiment of the present invention.

As shown in FIGS. 3-4, in a preferred embodiment, a plurality of radially extending tunnels 30 are defined in the cylindrical main body portion 12. A plurality of push rod assemblies 32 extend radially outwardly through tunnels 30. It will be appreciated that the term push rod assembly does not necessarily mean that the push rod assembly has more than one component. A single rod can be considered a push rod assembly. As is discussed herein, a number of different push rod assemblies can be part of the drive train that converts the rotational motion of the motor and motor shaft to reciprocating motion of the massage member. The push rod assemblies can cause the massage members 18 to have any desired amplitude or stroke. For example, the amplitude of reciprocation of a massage member between the stowed and the deployed position can be any number between 1 mm and 100 mm. The amplitude can also be adjustable, which can change the strength of the treatment provided to the user.

In the embodiment shown in FIGS. 2-4, the push rod assemblies 32 include the massage members 18 on the distal end thereof. The proximal end of the push rod assemblies 32 are operatively connected to or ride along one of the cam paths 26 (see FIG. 3). In use, as the cam shaft 24 rotates, as the proximal end of a push rod assembly 32 rides over a cam lobe 28 the massage member 18 on the distal end of the push rod assembly 32 moves radially outwardly from the stowed position to the deployed position.

The cam shaft 24 in FIG. 2 shows a number of different lobe combinations. This is shown to illustrate that one or more lobes can be located along a single cam path. It will be appreciated that the cam shaft (or multiple cam shafts) can be constructed so that it the massage members 18 are reciprocating outwardly in any number of different patterns. FIG. 2 also only shows a single push rod assembly 32 and massage member 18 to prevent the exploded view from being too cluttered.

The push rod assemblies 32 are biased inwardly toward and/or against the cam paths so that the massage members 18 remain or are normally in the stowed position. Any method or components for biasing the push rod assemblies 32 is within the scope of the present invention. As shown in FIGS. 3-4, in a preferred embodiment, the massage roller assembly 10 includes a plurality of springs 34 positioned along the tunnels 30 that bias the push rod assemblies 32 radially inwardly. The springs 34 are housed in spring recesses 36 that are a part of the tunnels 30. In a preferred embodiment, the push rod assemblies 32 include a flange or disc 38 that the springs 34 push against to provide the bias. The springs also push against an end of the spring recess.

As shown in FIGS. 2-4, in a preferred embodiment, the inner shell 20 includes a plurality of rod holes 40 defined therein through which the push rod assemblies 32 extend and that align with the tunnels 30. The massage roller assembly 10 includes end caps 42 that cap or cover the ends of the inner shell 20. The end caps 42 an house some or all of the electronics of the massage roller assembly. For example, the PCB 44 can be included on one of the end caps 42. FIG. 1 shows exemplary control buttons 46 that can be used in the control of the massage roller assembly 10.

As shown in FIG. 1, in a preferred embodiment, the outer cover 16 includes a plurality of massage protrusions 48. The massage protrusions 48 define a protrusion interior 50 into which the massage members 18 reciprocate and/or are housed. In the embodiment shown in FIG. 3, in the stowed position, the massage members 18 are partially housed in massage member recesses 52 and partially housed in the massage protrusions 48. As shown in FIG. 3, as the massage members 18 move to the deployed position they push against and deflect or stretch the outer cover 16 and the associated massage protrusion 48 (see, e.g., the massage member 18 at the top of FIG. 3). In another embodiment, the massage members 18 may not push against the massage protrusion 48, but instead are reciprocated into the protrusion interior 50 (or further therein such that they take up more of the volume thereof). The point is for the massage member 18 to move outwardly so that it pushes against a user that is using the roller.

In the embodiment of FIG. 4, where the outer cover is omitted, the massage members 18 are housed completely within the massage members recesses 52 and extend at least partially outside of the massage members recess 52 when deployed. When the massage members 18 are completely with in the massage member recesses 52 (or tunnels 30), the outer roller surface is essentially smooth. In other words, if the outer roller surface extended over the massage member recesses 52 ("the outer roller surface extended"), the outer roller surface extended would not extend through any of the massage members. Instead the massage members are positioned radially inward of the outer roller surface extended. In the deployed position, the massage members 18 extend through the outer roller surface extended and outside of the massage member recesses 52 and the tunnels 30. See the "outer roller surface extended" in FIG. 4 represented by dashed line Ll. In another embodiment, the massage members can include an outer surface that, when the massage member is positioned in the massage member recess, is substantially flush with the outer roller surface. In other words, when the massage members are in the stowed position the outer roller surface looks and feels smooth. Then, when the massage members move to the deployed position, they reciprocate outwardly from or with respect to the outer roller surface.

Figure 5:
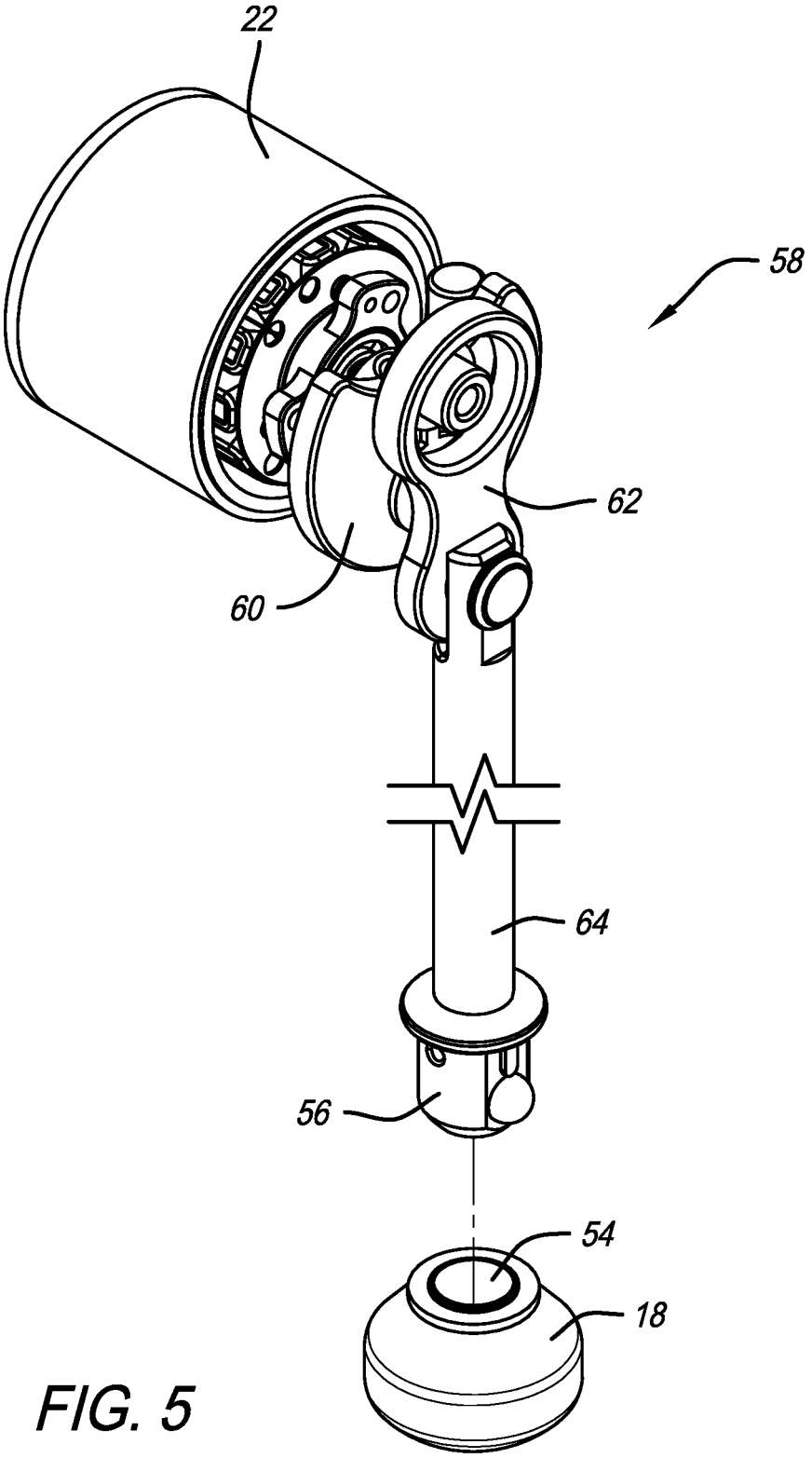
FIG. 5 is perspective view of a drive train.

As shown in FIG. 4 by the massage member 18 that is exploded from the distal end of the push rod assembly 32, the massage members can be removable so that they can be replaced by different massage members. This can change the strength or severity of the treatment provided by the massage roller. Any type of connection between the massage members and the distal ends of the push rod assemblies is within the scope of the present invention. As shown in FIG. 5, the massage member 18 can include a female connection member 54 and the push rod assembly 32 can include a male connection member 56 (see U.S. Pat. No. 10,617,588, the entirety of which is incorporated by reference in its entirety). In another embodiment, the massage member can include a male connection member and a female connection member can be included on the roller (or on the distal end of the push rod). If the same type of attachment system is used on the massage roller assembly 10 as the percussive therapy devices taught in the documents referenced herein the massage members can be advantageously swapped back and forth between the different devices.

FIG. 5 shows a type of drive train 58 that can be used in the massage roller assembly of the present invention. The drive train 58 includes a brushless motor 22, counterweight 60, and push rod assembly 32, which includes reciprocating shaft 62, push rod 64 and male connection member 56 on the distal end thereof. The motor 22 can drive one or more push rod assemblies 32 and massage members 18. The massage roller assembly 10 can include multiple drive trains 58 or portions thereof including a single drive train for each massage member.

Figure 6:
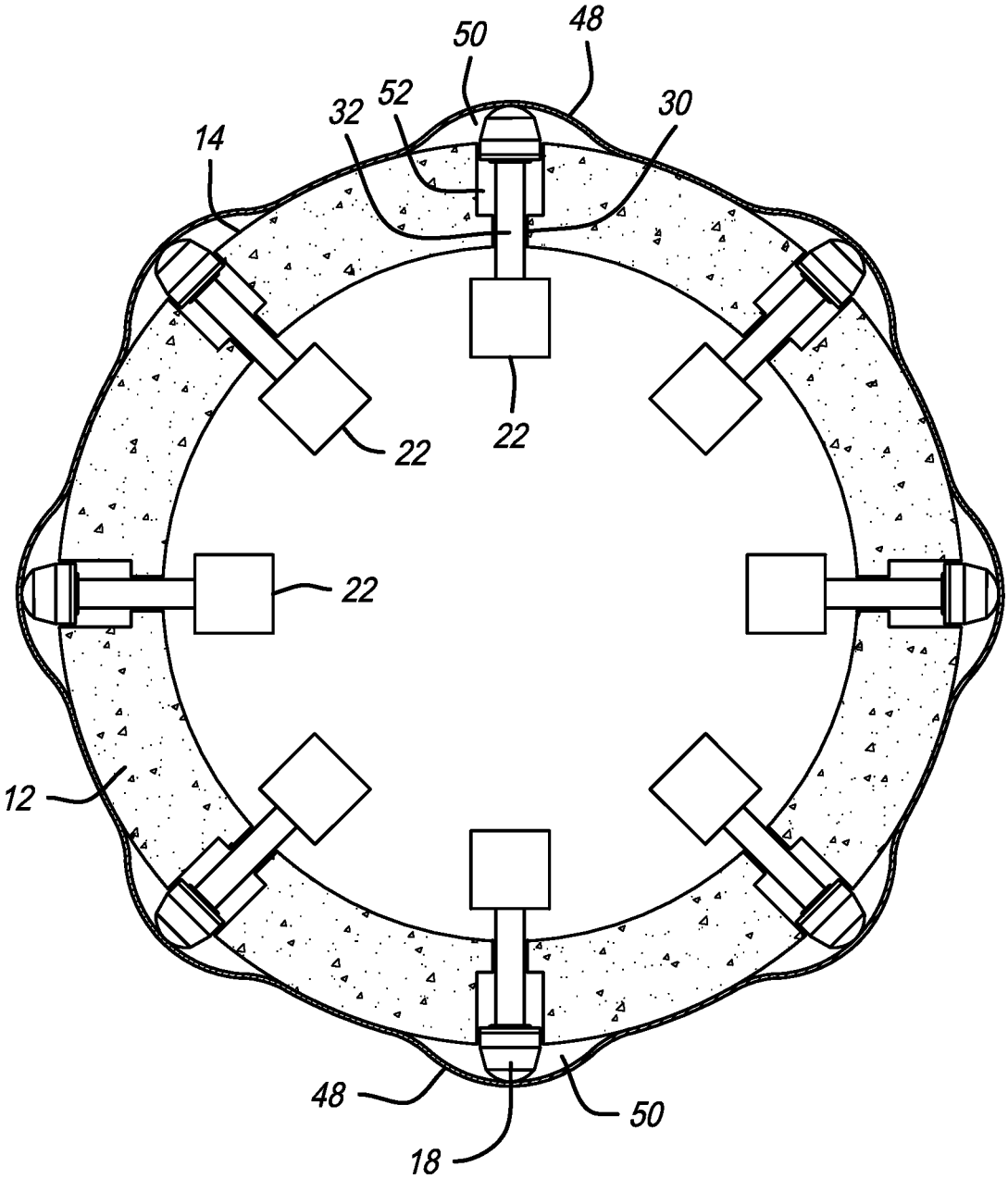
FIG. 6 is a cross-sectional end view of an embodiment of a massage roller assembly.

FIG. 6 shows another embodiment of the massage roller assembly 10 that includes a plurality of motors 22 distributed in a generally circular or round pattern throughout the interior of the cylindrical main body portion 12 that drive or reciprocate one or more massage members 18. The motors in this embodiment push and pull or reciprocate the push rod assemblies 32 and the massage members 18. In another embodiment, a plurality of rotating cam or crank shafts can be distributed in a generally circular or round array or pattern (e.g., in the same positions as the motors 22 in FIG. 6). In this embodiment, each rotating shaft is rotated by a motor and can operate one or more rows of massage members.

Figure 7:
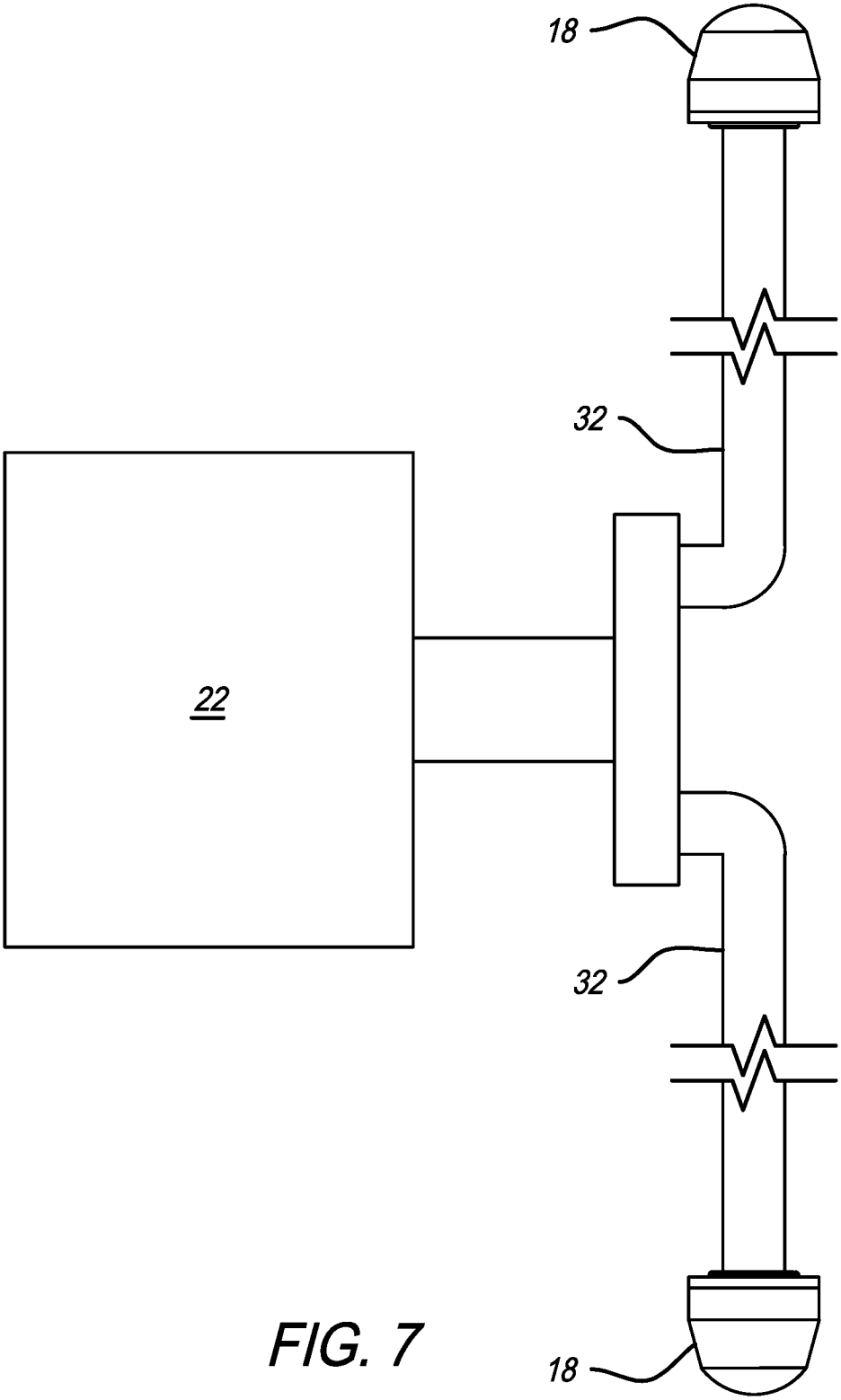
FIG. 7 is a schematic of a motor reciprocating two push rods.
Figure 8:
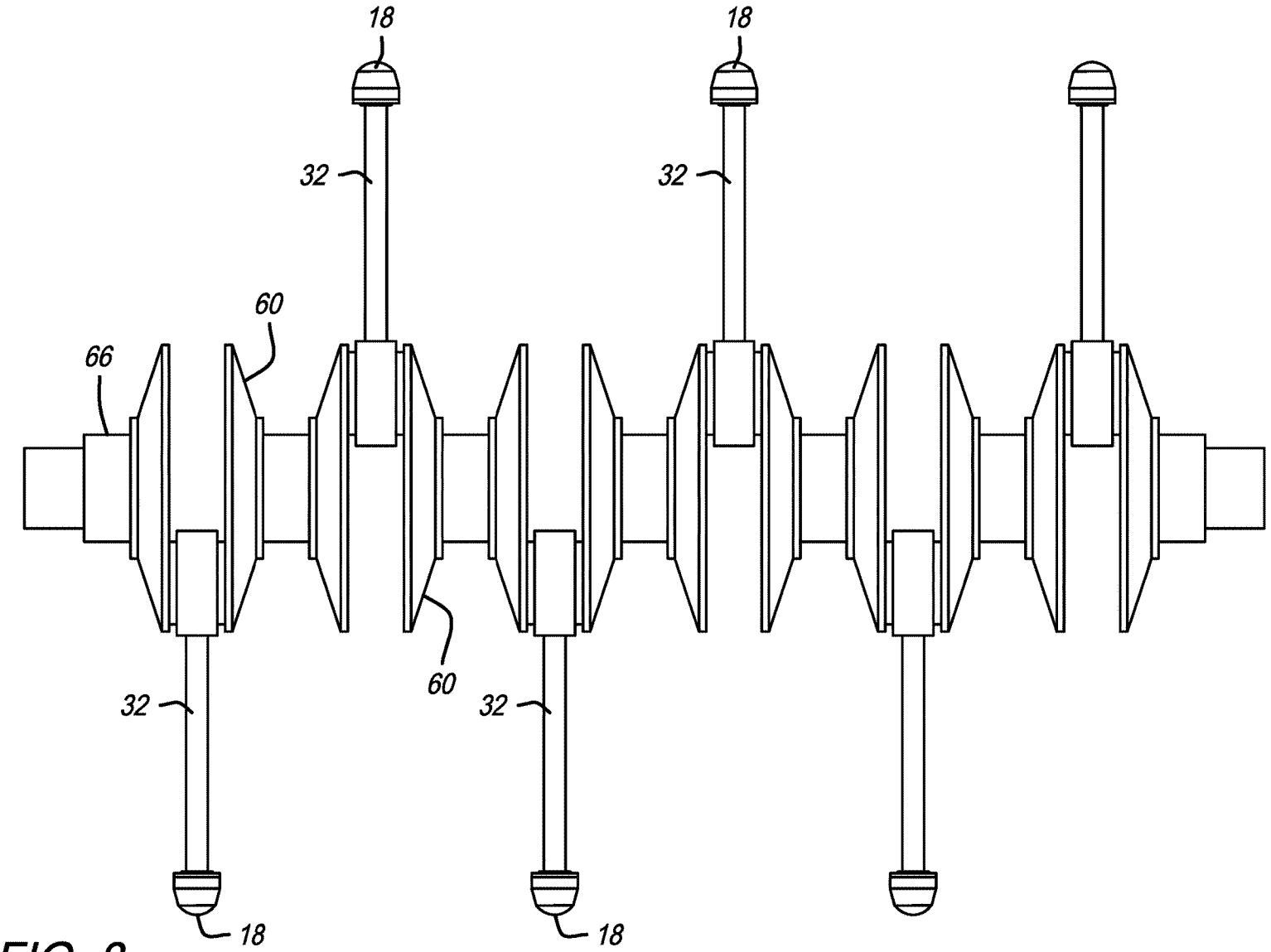
FIG. 8 is a crank shaft that includes a plurality of push rods and massage members extending therefrom.

FIG. 7 shows an embodiment where a single motor operates oppositely extending push rod assemblies 32 and massage members 18. FIG. 8 shows an exemplary crank shaft 66 that can be used to reciprocate a plurality of push rod assemblies 32 and massage members 18.

In a preferred embodiment, the massage roller assembly includes a controller that controls the motor(s) and/or the reciprocation of the massage members. For example, the controller can be a part of the PCB 44. The controller can include programming to provide different patterns of reciprocation of the various massage members. The controller can control such aspects as the stroke of the massage members and the speed or frequency of the reciprocation of the massage members. In a preferred embodiment, the massage members can be reciprocated outwardly and then stopped in the deployed or outward position to provide a peak or raised area that can be used for a user to "roll" thereon. For example, the user may place their hip flexor on the peak to treat that area based on their body weight and how it is generally understood that a massage or foam roller is used. This can be operated, for example, by a pause button.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A massage roller assembly comprising:

a cylindrical main body portion that defines a roller axis and includes an outer roller surface, wherein a plurality of radially extending tunnels are defined in the cylindrical main body portion and through the outer roller surface;

a plurality of massage members that include at least first and second massage members associated with the cylindrical main body portion, wherein each of the plurality of massage members is configured to reciprocate in a radial direction between a stowed position and a deployed position, and wherein in the deployed position, at least a portion of the first and second massage members are positioned radially outwardly of the cylindrical main body portion;

at least one motor, wherein the at least one motor rotates a motor shaft, wherein the rotation of the motor shaft is converted to reciprocating motion to reciprocate the plurality of massage members between the stowed and deployed positions; and a plurality of push rod assemblies that each includes a distal end, wherein the plurality of massage members is respectively located at the distal ends of the plurality of push rod assemblies.

2. The massage roller assembly of claim 1, wherein the motor shaft rotates a counterweight that is operatively associated with at least one of the plurality of push rod assemblies.

3. The massage roller assembly of claim 1, wherein the motor shaft is a cam shaft that includes at least one cam path that moves at least the first massage member of the plurality of massage members between the stowed and deployed positions.

4. The massage roller assembly of claim 3, wherein the plurality of massage members are biased to the stowed position.

5. The massage roller assembly of claim 1, further comprising an outer cover that at least partially surrounds the cylindrical main body portion, wherein the plurality of massage members deflect the outer cover when moving from the stowed position to the deployed position.

6. The massage roller assembly of claim 1, further comprising an outer cover that at least partially surrounds the cylindrical main body portion, wherein the outer cover includes a plurality of massage protrusions that each defines a protrusion interior, wherein the plurality of massage members move radially outwardly into the protrusion interiors of the respective massage protrusions when moving to the deployed position.

7. The massage roller assembly of claim 1, wherein each of the plurality of radially extending tunnels includes a massage member recess, wherein the outer roller surface defines an outer surface extended that extends over the plurality of massage members recesses, and wherein in the stowed position, the plurality of massage members are positioned radially inwardly of the outer surface extended.

8. The massage roller assembly of claim 1, further comprising a controller that controls the reciprocation of the plurality of massage members.

9. The massage roller assembly of claim 8, wherein the plurality of massage members comprise at least a first set and a second set, wherein the controller is configured to reciprocate the first set separately from the second set.

10. The massage roller assembly of claim 8, wherein the controller is configured to move the first massage member to the stowed position and remain in the stowed position, thereby providing a protrusion.

* * * * *